US005925855A

United States Patent [19]

Denndörfer

[11] Patent Number: 5,925,855

[45] Date of Patent: Jul. 20, 1999

[54] PLASTIC COMPOSITE INSULATOR WITH SPIRAL SHIELD AND PROCESS FOR PRODUCING IT

[75] Inventor: Heinz Denndörfer, Selb, Germany

[73] Assignee: Ceramtec AG Innovative Ceramic Engineering, Plochingen, Germany

[21] Appl. No.: 08/898,353

[22] Filed: Jul. 22, 1997

[30] Foreign Application Priority Data

Jul. 24, 1996 [DE] Germany ..... 196 29 796

[51] Int. Cl.[6] ..... H01B 17/06

[52] U.S. Cl. ..... 174/179; 174/212

[58] Field of Search ..... 174/176–179, 174/211, 212, 139

[56] References Cited

U.S. PATENT DOCUMENTS

| | | | |
|---|---|---|---|
| 3,003,022 | 10/1961 | Meier | 174/211 |
| 3,257,501 | 6/1966 | Sauer | 174/176 |
| 3,685,147 | 8/1972 | Nevin et al. | 29/624 |
| 4,246,696 | 1/1981 | Bauer et al. | 29/887 |
| 4,375,527 | 3/1983 | Zahner | 174/DIG. 1 |
| 4,833,278 | 5/1989 | Lambeth | 174/139 |
| 5,223,190 | 6/1993 | Vallauri et al. | 264/40.1 |

FOREIGN PATENT DOCUMENTS

| | | | |
|---|---|---|---|
| 260323 | 2/1968 | Austria | 174/211 |
| 2 046 682 | 2/1992 | Canada . | |
| 0 161 265 | 11/1985 | European Pat. Off. . | |
| 76305 | 2/1957 | France | 174/212 |
| 2363170 | 8/1976 | France | 174/179 |
| 27 46 870 | 8/1982 | Germany . | |
| 42 02 653 | 8/1992 | Germany . | |
| 640 666 | 1/1984 | Switzerland . | |
| 659 382 | 6/1979 | U.S.S.R. . | |
| 2 079 069 | 1/1982 | United Kingdom . | |

*Primary Examiner*—Nestor Ramirez
*Assistant Examiner*—Joseph Waks
*Attorney, Agent, or Firm*—Foley & Lardner

[57] ABSTRACT

A plastic composite insulator (1) including a shank (2) and at least one shield and caps (19), in which the shank comprises a fiber-reinforced plastic core (3) and, around this core, a jacket (5) of a shielding sheath (4) and in which the shielding sheath is formed by the jacket and at least one shield (6) running spirally around the shank, wherein the shielding sheath is formed in one part and without joints.

A process for producing a plastic composite insulator in which an adhesion promoter is applied to a fiber-reinforced plastic core (3), the plastic core pretreated in this way being introduced into an extruder (21) or into a ram press, which have a side-fed die (22) with a rotatable die ring (23), the transporting speed of the plastic core is coupled with the rotating speed of the die ring, the composition (24) for producing the shielding sheath (4) is compressed around the pretreated plastic core and is forced through the rotatable die ring, so that the pretreated plastic core is provided in the longitudinal direction with a shielding sheath including a jacket and a shield/shields in the form of a spiral. A rotating device may be used on the transporting device instead of on the die ring.

32 Claims, 3 Drawing Sheets

Figure 1:
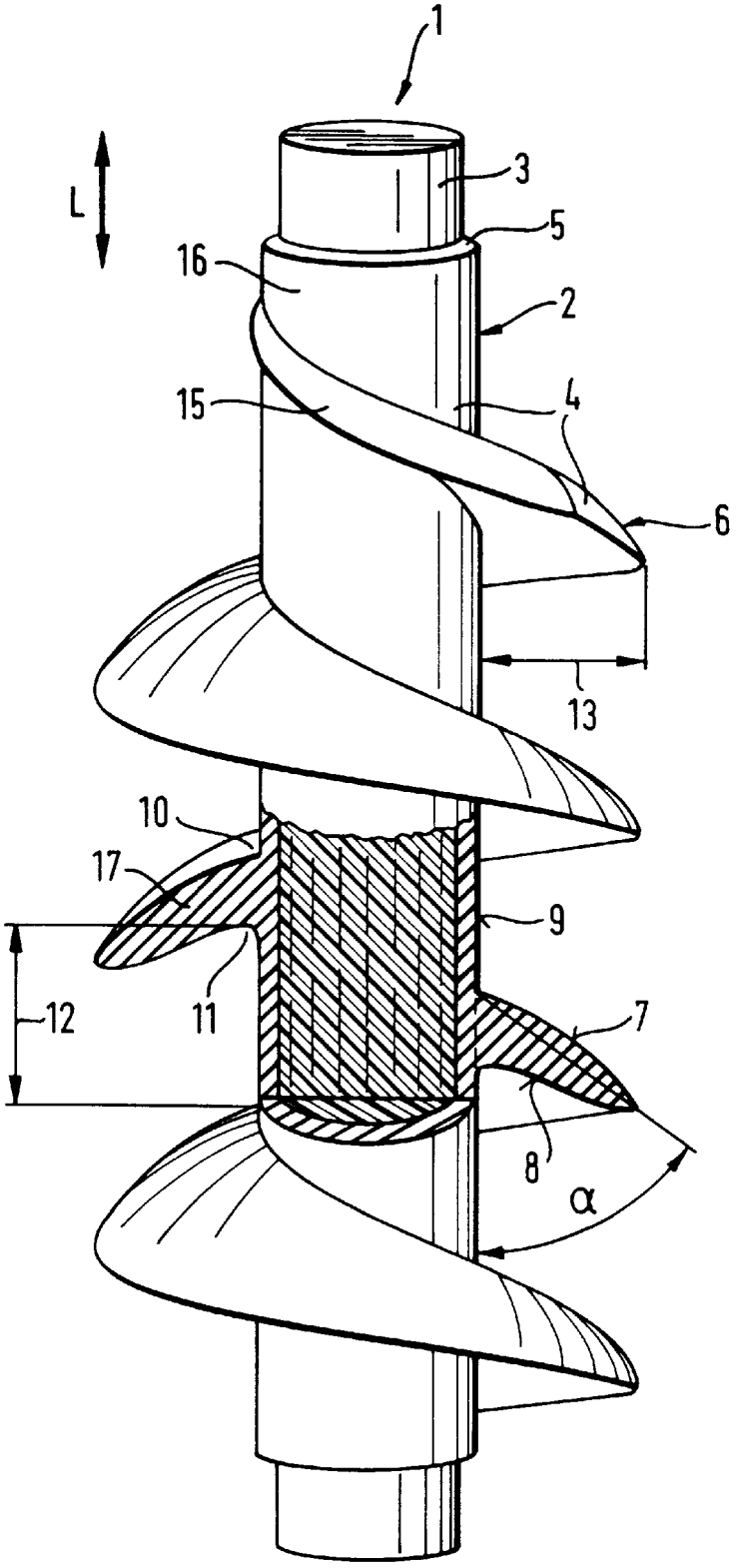

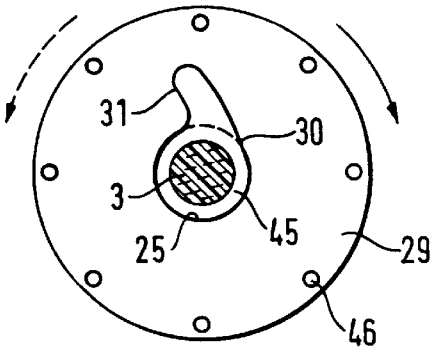
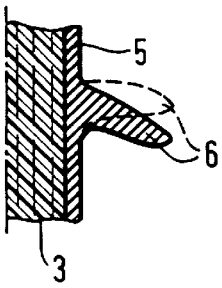
Fig. 4a
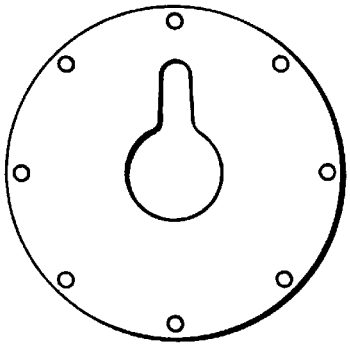
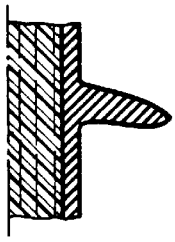
Fig. 4b
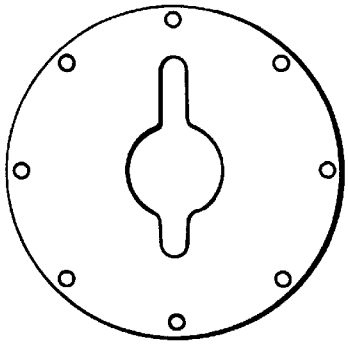
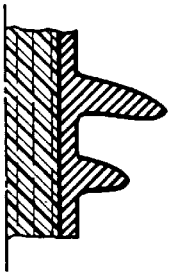
Fig. 4c
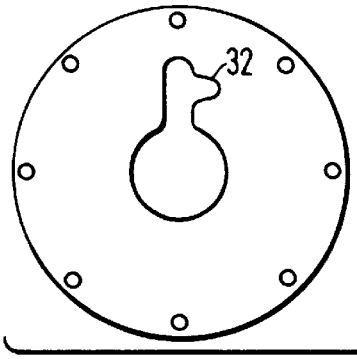
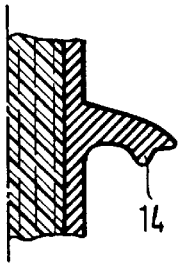
Fig. 4d
Fig. 4

PLASTIC COMPOSITE INSULATOR WITH SPIRAL SHIELD AND PROCESS FOR PRODUCING IT

The invention relates to a plastic composite insulator, the shank of which comprises a fiber-reinforced plastic core and, around this core, the jacket of a shielding sheath, the shielding sheath being formed by the jacket and at least one shield running spirally around the shank.

High-voltage insulators for overhead lines have long been produced from ceramic, electrically insulating materials such as porcelain or glass. Also gaining increasingly in significance are insulators which comprise a core of a material composite containing fibers and plastic and a shielding sheath of plastic, because they are distinguished by a series of advantages, included among which, along with its lower own weight, is also an improved mechanical resistance to projectiles from firearms. The shielding sheaths of such composite insulators are at the same time usually equipped with a considerable number of plate-shaped shields running approximately perpendicularly around the shank.

In comparison with conventional insulators of glass or porcelain, composite insulators have the advantage that they have excellent insulating properties when used in areas with highly contaminated atmosphere, since they are largely dirtrepellant and to some extent also encapsulate contaminants in an insulating manner. Therefore, composite insulators with shielding sheaths of silicone rubber are being used increasingly to upgrade existing overhead lines with electrical insulation problems resulting from atmospheric impurities, in that the conventional insulators of porcelain or glass are exchanged for composite insulators with a shielding sheath of silicone rubber.

High-voltage insulators of a composite design with plate-shaped shields are used for many applications, in particular for overhead lines. The production of composite insulators is known in principle. For example, according to DE-C2-27 46 870, they may be produced by sheathing a resin-impregnated glass fiber core (GRP=Glass-fiber-reinforced plastic) in silicone rubber by extrusion and pushing individually prefabricated plate-shaped shields with radial prestressing onto a sheathed glass fiber core and vulcanizing them together with the sheathing. The creepage path required for the insulator to operate can be obtained in particular by the number and diameter of the shields. The joint between the jacket sheathing the glass fiber core, in other words the surface of the shank, and the clearance in the plate-shaped shields is in this case a potential defect if the production process is not competently mastered and the joints are not tightly sealed.

DE-A1-42 02 653 teaches of a process for producing a composite insulator by injection molding a shielding sheath around a core, in order to avoid joints between the jacket and the plate-shaped shields of a shielding sheath, and of an apparatus for injection molding these insulators.

High-voltage insulators which have spiral shields are known: SU 659382 describes a process for producing a high-voltage insulator from porcelain which is formed with spiral ribs with the aid of an extruder having a rotating disk, which contains an opening for the ceramic mass; details of the rotating disk are not specified. CH-A5-640 666 teaches of a composite insulator with spiral shields, in which a prefabricated rib-shaped elastomer profiled band is wound around a GRP core and vulcanized on.

According to CA-A1-2,046,682, a similar rib-shaped elastomer profiled band, having a parallelogram-shaped cross section, for the jacket is wound around an insulating core, such as for example a GRP tube, and is vulcanized on. According to EP-B1-0 161 265, a thin, shield-forming, helical band of silicone rubber is formed on a plate, lifted off and wound around a GRP core and adhesively attached; this process has a number of drawbacks: On account of the production process, it is not possible to apply the shielding band in such a way that no shield deformations occur. The nylon filament in the region of the shield root is unable to solve this problem, since it is rather the case that through this filament destructive glow discharges can occur in the filament/shield interface. According to the patent, the adhesive for fastening the shielding band on the GRP core also serves the purpose of protecting the GRP core in the shield interspaces; however, this extremely thin layer does not appear to be capable of offering reliable protection, particularly not when high-current partial arcs occur on the insulator surface. The short adhesive joint, resulting from the small shield thickness, is likewise a weak point, because it is very much at risk of destructive discharges.

The abovementioned production processes for plastic composite insulators result in joints and/or seams and hence readily have adverse electrotechnical effects. They also have the disadvantage that an especially high number of operations are required for production and they are therefore extremely cost-intensive with respect to working time and use of energy.

The invention was therefore based on the object of providing composite insulators which have greater functional reliability and better electrotechnical characteristic data and at the same time of providing a lower-cost alternative for producing such composite insulators.

The object is achieved according to the invention by a plastic composite insulator comprising a shank and at least one shield and caps, in that the shank comprises a fiber-reinforced plastic core and, around this core, a jacket of a shielding sheath and in which the shielding sheath is formed by the jacket and at least one shield running spirally around the shank, wherein the shielding sheath is formed in one part and without joints.

The object is also achieved according to the invention by two processes for producing such a plastic composite insulator in conjunction with the associated apparatuses.

It was surprisingly found that, contrary to the view held by those skilled in the art, the composite insulators according to the invention can be produced in a much simpler way. In addition, it was found that the contamination of the insulator is less and so it could be rinsed off more easily than in the case of comparable composite insulators with plate-shaped shields.

The plastic core of the composite insulators according to the invention may be reinforced with fibers of a low-alkali glass. It may, in particular, be of a cylindrical, convexly curved or conical design and consequently determines the basic shape of the shank. The plastic core may be a solid rod or a hollow body, preferably in the form of a tube or a hollow cone.

Preferably used as the material for the shielding sheath is a silicone rubber of which the Shore A hardness is more than 40, in particular 60 to 90. HTV rubber (HTV=high temperature vulcanizing) may be used with preference for this. The shielding sheath may contain rubber which is vulcanizable at increased temperature—generally 50° C. to 200° C.—, in particular EPDM (terpolymer of ethylene, propylene and a diene, with the unsaturated part of the diene on the side chain) and/or EPM (ethylene-propylene copolymer), polyinyldimethylsiloxane and fillers, preferably crosslinked with the aid of peroxides, or general polyorganodimethylsiloxanes. Further types of suitable HTV silicone rubber comprise MQ, FMQ, PMQ and VMQ, corresponding to DIN ISO 1629. The shielding sheath usually has a smooth surface without longitudinal seams and without transverse seams. A particularly smooth surface is to be preferred because of a lower tendency to become contaminated and better insulating effect. The jacket is preferably of substantially the same thickness or contoured with ribs, channels or corrugations—preferably running around spirally, so that water can run off well. The upper side of the spiral shields is generally convexly shaped, while the underside of the spiral shields is often concavely shaped. The underside of the spiral shields may have a corrugation or at least one rib or at least one channel, which help to lengthen creepage paths, stiffen the shields and deflect flowing water, which can also transport dirt away. These shield contours may also be directed radially with respect to the shank or such that they run outward. Generally, the transitions between the surface of the shields and the surface of the jacket are rounded or, when there is very little distance between two shields, rounded continuously from one shield to the next shield. The chord of the cross-sectional area intersecting the upper side of the shields in the longitudinal direction of the insulator usually forms an angle a of 30° to 80° with the longitudinal direction L. The spiral shields may have run-outs to the sides toward the caps, with which run-outs the projection of the shields usually decreases continuously up to the point of attachment on the shank. An exemplary design exhibits at least one spiral shield which is interrupted in the central region of the shank and has run-outs to the sides of this interruption or a reduced projection in the region of the interruption. Other designs may be distinguished in that they have at least one spiral shield which is provided with a shield cross section varying over the length or that only at a relatively large distance from a cap is there formed on at least one spiral shield with a run-out. The composite insulator may have at least two spiral shields, which exhibit a cross section which is different in the case of one shield than in the case of the other. It may be provided, at least in one region of the shank, with a close succession of shield portions in longitudinal section—similar to a comb. The distance between the shield portions in a longitudinal section may vary over the length of the shank, for example on account of the changed angle of inclination or a greater number of spiral shields. Just by increasing the rotational speed of the rotating device at the die ring or the rotating device for the plastic core, it is very simple to make the shield portions closer together and to reduce the angle of inclination of the shields and consequently lengthen the creepage path. The angle of inclination may in this case be varied such that one revolution of a spiral shield through 360° corresponds to a lead in the longitudinal direction L of from 10 mm to way beyond 1000 mm. In addition, particularly if all the spiral shields are formed on only at quite a relatively large distance from the cap, one or more plate-shaped shields may be formed on or applied to the shank, at least at one end of the shank.

The plastic core may take up a length of between 10 cm and 8 m and thereby determines approximately the length of the overall insulator. The spiral shields may have—apart from at the ends of the run-outs—a projection perpendicularly with respect to the shank from the surface of the jacket of from 5 to 100 mm, in particular from 10 to 70 mm, particularly preferred from 15 to 40 mm. The distance between two shield portions in the longitudinal direction L, measured close to the surface of the jacket, may be 5 to 1000 mm, in particular 10 to 500 mm, particularly preferred 20 to 100 mm.

The straightness deviation of a substantially straight line on the surface of the shielding sheath is usually no more than 0.5 mm, preferably no more than 0.3 mm, in particular no more than 0.1 mm.

The shield design according to the invention offers still further advantages: Silicone rubber is known to be an expensive material, because the silicone synthesis starts from pure silicon. Insulator designs with plate-shaped shields of silicone rubber are therefore aimed at minimizing the use of material, which results in thin shields. Thin shields of silicone rubber, in particular those of relatively great projection, are mechanically unstable under certain circumstances, they tend to undergo deformation during storage and transportation and can also easily be mechanically damaged. By the selection of a suitable shield cross section in conjunction with the angle of inclination and, if appropriate, with the use of channels, ribs or corrugations on the undersides of the shields, the shields may be provided with a smaller projection than plate-shaped shields, while having the same or an even greater creepage path, and thereby gain a considerable degree of mechanical stability through the stiffening effect of the contour on the undersides of the shields for this soft flexible material. The use of material for the shields with channels, ribs or corrugations is small and is largely compensated by the length of creepage path thereby gained, since a lengthening of the creepage path in the case of flat plate-shaped or spiral shields can be achieved only by increasing the diameter, the effect of which is raised by the power of two in the material calculation.

The composite insulators according to the invention have neither joints nor customary seams. At those seams which normally have a thin skin running in the longitudinal direction of the insulator, perpendicular to the shielding sheath, dirt particles can accumulate locally and have disruptive electrotechnical effects. The curved and inclined spiral shields are particularly advantageous in rain, since the rainwater does not run away down along the spirals but is deflected outward and drips off on account of the shape of the shield.

It is known that visible electrical discharges and partial arcs can occur on all types of high-voltage insulators in operation. These discharges are very intensive and, in particular at the voltage-side end of the insulator in the region of the shank between the cap and the first shield following after the cap, of high energy. Observations have shown that these discharges may occur with preference on the shank and on the zones of the undersides of the shields which are close to the shank. The discharge intensity along the longitudinal axis of the insulator decreases with increasing distance from the voltage-carrying conductor. Even in the case of plastic composite insulators with plate-shaped shields, discharges may occur between the cap and the first shield following thereafter—in particular in regions with high air contamination—, said discharges causing erosion in the shielding sheath and, in serious cases, destruction of the barrier which prevents the d shield acts as a barrier which prevents the discharges running out in the direction of the ground side of the insulator.

In the case of the plastic composite insulator according to the invention, which has only spiral shields, the discharges can travel further along the shank, their intensity dissipating. In this case there occur no great local current densities which could cause erosion.

In the production of plastic composite insulators, according to the invention, a high proportion of rubber can be saved in comparison with a conventional plastic composite insulator of the same length and the same creepage path. In general, a saving of about 40% is to be expected. The following table lists the corresponding data in comparison for two different types, for composite insulators according to the prior art and for composite insulators according to the invention; the characteristic data concerning weight apply to discontinuous production, in which the ends of the shank have not been entirely covered by a jacket

| Composite insulator type | Shields | Overall length | Creepage path | Weight of shielding sheath | Weight saving |
|---|---|---|---|---|---|
| 30/3(168) | 3 plate shields | 430 mm | 550 mm | 730 g | — |
| 430 | 1 spiral shield with 11.25 turns | 430 mm | 550 mm | 319 g | 56% |
| 30/2(168) | 2 plate shields | 405 mm | 405 mm | 520 g | — |
| 405 | 1 spiral shield with 7.5 turns | 405 mm | 405 mm | 234 g | 55% |

The composite insulators according to the invention may be produced by the following processes:

One process for producing a plastic composite insulator comprises applying an adhesion promoter to a fiber-reinforced plastic core, introducing the plastic core pretreated in this way into an extruder or into a ram press, which have a side-fed die with a rotatable die ring, the transporting speed of the plastic core being coupled with the rotating speed of the rotatable die ring, compressing the composition for producing the shielding sheath around the pretreated plastic core and forcing it through the rotatable die ring, so that the pretreated plastic core is provided in the longitudinal direction with a one-part sheathing sheath comprising a jacket and a shield/shields in the form of one or more spirals. In addition, the plastic core may in this case be introduced in a rotating manner into an extruder or into a ram press, it being possible for the transporting speed of the plastic core to be coupled with its rotating speed.

In another process for producing a plastic composite insulator, an adhesion promoter is applied to a fiber-reinforced plastic core, the plastic core pretreated in this way being introduced in a rotating manner into an extruder or into a ram press, which have a side-fed die with a die ring, the transporting speed of the plastic core being coupled with its rotating speed, and the composition for producing the shielding sheath is compressed around the pretreated plastic core and is forced through the opening of the die ring, so that the pretreated plastic core is provided in the longitudinal direction with a one-part shielding sheath comprising a jacket and a shield/shields in the form of one or more spirals.

In this case, the adhesion promoter may be applied to the plastic core before sheathing with composition, by spraying on, brushing on or immersing. The adhesion promoter usually serves as an adhesion promoter for vulcanizing and may be used on a silane base. It may be applied to the plastic core as a liquid film of, for example, about 1 $\mu$m in thickness.

The processes may be carried out continuously or discontinuously, at constant or changing speed. The speed of the rotating devices or the transporting device may be varied in wide limits, but it must be ensured that excessive speed does not cause shearing to occur between the coated plastic core and the rubber composition, since otherwise in particular the shields may be torn off. In production, the size or/and the shape of the opening of a die ring may be changed during extrusion by means of an extruder or ram press, in particular if a suitable device for changing the opening is provided; for example, the spiral shields may be pressed to the sides toward the caps, with run-outs. The ends of the spiral shields may, however, also be beveled, rounded off or worked to the sides toward the caps to form run-outs. The ends of the spiral shields may also be simply cut off, slight rounding of the edges being advantageous. In the production of the insulators according to the invention, it must be ensured that the side-fed die is filled completely with composition, and without any entrapped air, during extrusion and that the composition is discharged for the shielding sheath without any entrapped air. The production process for the shank is essentially completed by bonding the plastic core to the shielding sheath by vulcanizing. The vulcanizing may be performed downstream of the side-fed die in a heating zone. In this case it must be ensured that the outer region of the plastic core also reaches an adequate temperature for vulcanizing. It has been shown that the use of an adhesion promoter may be very beneficial for the result of vulcanizing, because in this way a chemical bond can be produced between the two parts to be vulcanized together, without any blisters or fissures. Water can accumulate in blisters or fissures and may result in adverse electrotechnical effects, primarily by glow discharges. Glow discharges may lead to arcs, which can destroy the insulator.

The composite insulators according to the invention may be produced with the aid of the following apparatuses:

An apparatus for producing a plastic composite insulator according to the invention comprises an extruder or a ram press, a side-fed die, a die ring with an opening and a transporting device for the plastic core, the die ring being equipped with a rotating device. Another apparatus for producing a plastic composite insulator according to the invention comprises an extruder or a ram press, a side-fed die, a die ring with an opening and a transporting device for the plastic core, the transporting device being equipped with a rotating device for the plastic core. The die ring may contain a profile disk, which is resiliently mounted, and conceals an opening, which is arranged with preference in a profile disk. The opening may have a circular clearance, which is arranged centrally with respect to the transporting axis of the plastic core and merges in a radial or angled-off direction with at least one approximately peg-shaped extension. The opening may in the region of the approximately peg-shaped extension have at least one constriction or at least one second extension, branching off from this extension. It may be provided with a device by which the opening can be changed in size and/or in shape during operation. The circular clearance of the opening may have a diameter which is at least 0.2 mm greater than the diameter of the plastic core at the associated point when transporting through the opening.

The profile die serving for shaping the shielding sheath can be of such a simple construction that it is possible to respond quickly, flexibly and with low costs to customer requests with respect to shank and shield design, and no expensive tools have to be provided specifically for one type.

The high-voltage insulator of composite design according to the invention, its production process and the associated apparatus are to be illustrated by way of example with reference to four drawings:

FIG. 1 shows a detail of a plastic composite insulator according to the invention. The central portion of the insulator 1 comprises a shank 2 and a shield 6 wound spirally around said shank. The shank 2 comprises a fiber-reinforced plastic core 3, which may be composed of epoxy resin-sheathed glass fibers which are arranged "endlessly" and, in the case of cylindrical cores, axially parallel, and a shielding sheath 4: The plastic core 3 is sheathed by a jointlessly formed layer of the jacket 5, which merges without joints with the spiral shield 6. A detail of FIG. 1 is drawn as longitudinal section, in which the chord of the cross-sectional area intersecting the upper side of the shields in the longitudinal direction of the insulator forms an angle a of 30° to 80°, preferably of 40° to 70°, with the longitudinal direction. Here, the cross section of a shield 17 can be clearly seen. The transitions of the upper side 7 and of the underside 8 of the spiral shield 6 into the surface of the jacket 9 may be of a sharp-edged form, but preferably of a rounded form, 10 and 11, in particular with a radius of 0.1 to 12 mm. FIG. 1 shows an example of an insulator according to the invention with constant diameters, with a cylindrical shank 2 without a cavity and with a single spirally wound shield 6 of constant cross section. Alternatively, a plurality of shields of the same or different cross section or shields with ribs, channels or corrugations 14 of different alignment and arrangement may also be used. FIG. 1 also shows the shank ends 16 with the run-outs 15 of the shields, but does not show the caps, which are usually designed in the forms of metal fittings. The caps serve for transferring the tensile force from the plastic core 3 to the insulator suspension or fastening (not shown). The cap may be composed, for example, of steel, cast iron or other metallic materials and be connected to the end of the plastic core 3 by radial compression. In addition, 12 and 13 show the distances between two shield portions and the projection of the shield.

Figure 2:
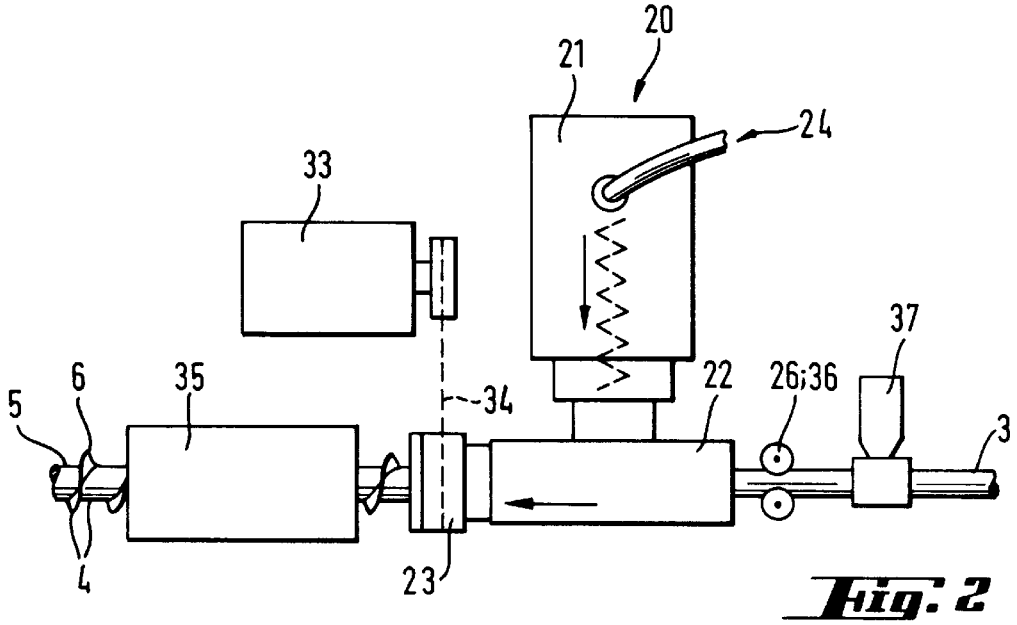

FIG. 2 shows an apparatus 20 for producing the plastic composite insulator 1 in the region of an extruder 21. The composition 24 for producing the shielding sheath 4 is conveyed by the extruder 21 into the side-fed die 22. The device for adhesion promoter application 37, the transporting device 26 for the plastic core 3 with the anti-twisting means 36, the side-fed die 22 with the rotatable die ring 23 and the heating zone 35 for vulcanizing the shielding sheath are arranged axially in such a way that the plastic core 3 can be passed centrally through corresponding clearances. The die ring 23 is driven by the drive 33 and 34.

Figure 3:
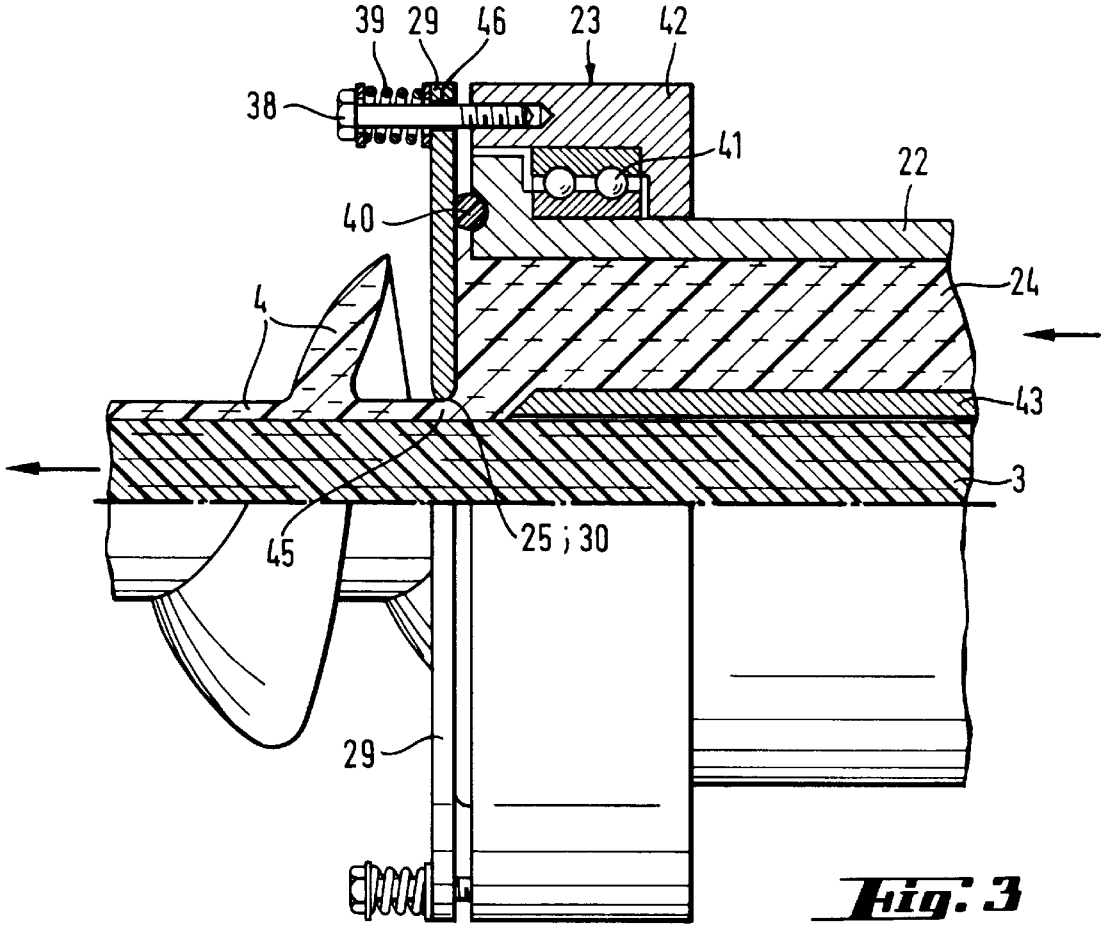

FIG. 3 reproduces a partial section of the discharge end of the side-fed die 22 and of the rotatable die ring 23. Passed centrally through the side-fed die 22 and at a small distance from the mandrel 43 is the plastic core 3, around which the composition 24 for the shielding sheath 4 behind the mandrel 43 is forced, being forced through the gap 45 of the approximately circular clearance 30 between the plastic core 3 and the edge of the opening 25 and also through the extension 31 and, if appropriate, through a second extension 32, and is formed into the shape of the jacket 5 and the spiral shield 6. The die ring 23 is mounted rotatably about the side-fed die 22 by means of the ball bearing 41. The profile disk 29 with the opening 25 is connected to the housing of the rotatable die ring 23 by means of screws 38 and compression springs 39. The cross section of the opening 25 determines the cross section of the shielding sheath 4 formed there. The interior space of the sidefed die 22 is sealed off between the profile disk 29 and the housing of the die ring 23 by a sealing and sliding ring 40, which may advantageously be of PTFE. The tightening torque must be the same for all the screws 38, in order that the pressure on the profile disk and the sealing and sliding ring 40 is distributed approximately equally over the entire circumference. The tightening torque must be great enough that no composition 24 can escape in the region of the sealing and sliding ring 40 during operation, but satisfactory rotation of the die ring 23 is ensured. For this purpose, exact torque setting, compensation for the deformation of the sealing and sliding ring 40 and consequently uninterrupted contact between the profile disk 29 and the sealing and sliding ring 40 is achieved by means of the compression springs 39. In this way, reliable sealing off can be accomplished. The adhesion promoter applied to the plastic core 3 is not shown in any of the figures.

FIG. 4 illustrates on the left by several partial representations different profile disks 29 of a rotatable die ring 23 with differently shaped openings 25, which have circular clearances 30 which merge in a radial or angled-off direction with approximately peg-shaped extensions 31 and may be curved or of a straight alignment, according to requirements. In addition, second extensions 32 may branch off sideways from the extensions 31, in order for ribs or corrugations 14 to be formed on. The profile disk 29 may be connected to the housing of the rotatable die ring 23 by means of fastening bores 46. A device which changes the opening 25 in size or/and in shape during extrusion is not shown here. The changing of the opening 25 may take place uniformly over the duration of extrusion for an insulator, for example to shape the shank conically, or for a brief time, in order for example to produce transverse ribs. To the right next to the partial representations of the various profile disks 29 there are produced longitudinal sections taken in the form of details through the strand 2 comprising the plastic core 3 and the jacket 5 and also through the spiral shield 6, which can be obtained by means of the openings 25 shown on the left.

In principle, the shape and size of the opening 25 determines the cross section of the shielding sheath 4. However, in the case of this plastic, not yet vulcanized material, the resulting shield cross section 17 is not identical to the shape of the opening 25. Produced in this way, generally a more or less inclined and curved spiral shield 6 is obtained. This shield 6 usually has a shape in which it is thicker where it is closer to the shank 2 and becomes thinner toward the edge of the shield 6. With an identical opening 25, changing the rotating speed can result in a differently shaped shield cross section 17. In the partial representations a to d, different variants of the opening 25 and the resultant shield cross sections 17 are shown. Therefore, the number, size and shape of the spiral shields 6 can be influenced by simple means.

The invention has been explained in detail above by way of example by referring to a high-voltage insulator for overhead lines, the production process and the apparatus required for production. It is self-evident that a composite insulator according to the invention may be used as high-voltage equipment or as a housing for electrical equipment, in particular in outdoor applications, a wide variety of areas of use coming into consideration. The invention may also be advantageously used in those cases where conventional insulators of fixed overall height present electrical problems with regard to flashovers in regions of atmospheric contamination. The invention can be used to fabricate insulators of which the creepage path can be adapted to atmospheric conditions while the overall height remains the same.

I claim:

1. A plastic composite insulator comprising a shank and at least one shield and cap, in which the shank comprises a fiber-reinforced plastic core and, around said core, a jacket of a shielding sheath and in which the shielding sheath is formed by the jacket and said at least one shield running spirally around the shank, wherein the shielding sheath is formed in one part and without joints and said jacket and the at least one spiral shield are one piece.

2. The plastic composite insulator as claimed in claim 1, wherein said shielding sheath has an outer surface without longitudinal seams and without transverse seams.

3. The plastic composite insulator as claimed in claim 1, wherein the spiral shields have an upper side, and the upper side of the spiral shields is convexly shaped.

4. The plastic composite insulator as claimed in claim 3, wherein a chord of a cross-sectional area intersecting the upper side of the at least one shield in a longitudinal direction of the insulator forms an angle $\alpha$ of 30° to 80° with the longitudinal direction (L).

5. The plastic composite insulator as claimed in claim 1, wherein the spiral shields have an underside and the underside of the spiral shields is concavely shaped.

6. The plastic composite insulator as claimed in claim 5, wherein the underside of the spiral shields has a corrugation or at least one rib or at least one channel.

7. The plastic composite insulator as claimed in claim 1, wherein the plastic core is reinforced by fibers of low-alkali glass.

8. The plastic composite insulator as claimed in claim 1, wherein the shielding sheath contains rubber which is a high temperature vulcanizing rubber.

9. The plastic composite insulator as claimed in claim 1, wherein the at least one shield has run-outs to sides that extend toward a cap.

10. The plastic composite insulator as claimed in claim 1, wherein the at least one shield has a central region of the shank which has an interruption and the interruption has sides, and further wherein the shank has run-outs to the sides of the interruption or (ii) a reduced projection in a central region of the interruption.

11. The plastic composite insulator as claimed in claim 1, wherein the at least one shield is provided with a shield cross section that has a length and the shield cross section varying over the length of the at least one spiral shield.

12. The plastic composite insulator as claimed in claim 1, wherein only at a distance from a cap is there formed on the at least one shield with a run-out.

13. The plastic composite insulator as claimed in claim 1, wherein said insulator has at least two of the at least one spiral shield having different cross sections.

14. The plastic composite insulator as claimed in claim 1, wherein said insulator is provided, at least in one region of the shank, with a close succession of comb-like shield portions a longitudinal section.

15. The plastic composite insulator as claimed in claim 1, wherein at least one plate-shaped shield is formed on or applied to the shank, at least at one end of the shank.

16. The plastic composite insulator as claimed in claim 1, wherein run-outs of the at least one spiral shield have ends and the ends of the run-outs have a projection perpendicularly with respect to the shank from a surface of the jacket of from 5 to 100 mm.

17. The plastic composite insulator as claimed in claim 1, wherein a distance between two shield portions in a longitudinal direction L, measured close to the surface of a jacket, is 5 to 1000 mm.

18. The plastic composite insulator as claimed in claim 1, wherein the plastic core is cylindrical, bulgedly curved or conical.

19. The plastic composite insulator as claimed in claim 1, wherein the plastic core is a solid rod or a hollow body.

20. A process for producing a plastic composite insulator as claimed in claim 1, wherein an adhesion promoter is applied to a fiber-reinforced plastic core, wherein the plastic core pretreated in this way is introduced into an extruder or into a ram press, which have a side-fed die with a rotatable die ring, wherein the transporting speed of the plastic core is coupled with the rotating speed of the rotatable die ring, wherein the composition for producing the shielding sheath is compressed around the pretreated plastic core and is forced through the rotatable die ring, so that the pretreated plastic core is provided in the longitudinal direction with a one-part shielding sheath comprising a jacket and a shield/shields in the form of one or more spirals.

21. The process for producing a plastic composite insulator as claimed in claim 20, wherein the plastic core is introduced in a rotating manner into an extruder or into a ram press and wherein the transporting speed of the plastic core is coupled with its rotating speed.

22. The process for producing a plastic composite insulator as claimed in claim 20, wherein an adhesion promoter is applied to the plastic core before sheathing with composition, by spraying on, brushing on or immersing.

23. The process for producing a plastic composite insulator as claimed in claim 20, wherein an adhesion promoter based on silane is used.

24. The process for producing a plastic composite insulator as claimed in claim 20, wherein the size or/and the shape of the opening of a die ring is changed during extrusion.

25. The process for producing a plastic composite insulator as claimed in claim 20, wherein the spiral shields are pressed to the sides toward the caps, with run-outs.

26. The process for producing a plastic composite insulator as claimed in claim 20, wherein the ends of the spiral shields are beveled, rounded off or worked to the sides towards the caps to form run-outs.

27. The process for producing a plastic composite insulator as claimed in claim 20, wherein the plastic core is bonded to the shielding sheath by vulcanizing.

28. A process for producing a plastic composite insulator as claimed in claim 1, wherein an adhesion promoter is applied to a fiber-reinforced plastic core, wherein the plastic core pretreated in this way is introduced in a rotating manner into an extruder or into a ram press, which have a side-fed die with a die ring, wherein the transporting speed of the plastic core is coupled with its rotating speed, wherein the composition for producing the shielding sheath is compressed around the pretreated plastic core and is forced through the opening of the die ring, so that the pretreated plastic core is provided in the longitudinal direction with a one-part shielding sheath comprising a jacket and a shield/shields in the form of one or more spirals.

29. The plastic composite insulator as claimed in claim 1, wherein run-outs of the at least one spiral shield have ends, and the ends of the run-outs have a projection running perpendicularly with respect to the shank from the surface of the jacket of from 10 to 70 mm.

30. The plastic composite insulator as claimed in claim 1, wherein run-outs of the at least one spiral shield have ends, and the ends of the run-outs have a projection running perpendicularly with respect to the shank from the surface of the jacket of from 15 to 40 mm.

31. The plastic composite insulator as claimed in claim 1, wherein a distance between two shields in a longitudinal direction L, measured close to a surface of the jacket, is 10 to 500 mm.

32. The plastic composite insulator as claimed in claim 1, wherein a distance between two shields in a longitudinal direction L, measured close to a surface of the jacket, is 20 to 100 mm.

* * * * *